US006387866B1

(12) United States Patent
Mondin et al.

(10) Patent No.: US 6,387,866 B1
(45) Date of Patent: May 14, 2002

(54) ANTIMICROBIAL MULTI PURPOSE CONTAINING A CATIONIC SURFACTANT

(75) Inventors: Myriam Mondin, Seraing; Claude Blanvalet, Angleur; Nicole Andries, Voroux-Lez-Liers, all of (BE); Pierre Fonsny, St. Ives (AU); Didier Dormal, Aywaille (BE)

(73) Assignee: Colgate-Palmolive Co., Piscataway, NJ (US)

( * ) Notice: Subject to any disclaimer, the term of this patent is extended or adjusted under 35 U.S.C. 154(b) by 98 days.

(21) Appl. No.: 09/599,196

(22) Filed: Jun. 22, 2000

Related U.S. Application Data

(63) Continuation-in-part of application No. 09/342,354, filed on Jun. 26, 1999, now Pat. No. 6,130,196.

(51) Int. Cl.[7] ..... C11D 1/62; C11D 1/722; C11D 1/831; C11D 1/86

(52) U.S. Cl. ..... 510/384; 510/101; 510/238; 510/239; 510/240; 510/362; 510/387; 510/391; 510/422; 510/426; 510/389; 510/432; 510/437; 510/475; 510/499; 510/504; 510/506

(58) Field of Search ..... 510/101, 238–240, 510/384, 362, 387, 391, 422, 426, 389, 432, 437, 475, 499, 504, 506

(56) References Cited

U.S. PATENT DOCUMENTS

| | | | | | |
|---|---|---|---|---|---|
| 5,008,030 | A | * | 4/1991 | Cook et al. | 252/106 |
| 5,728,672 | A | * | 3/1998 | Richter | 510/463 |
| 5,965,514 | A | * | 10/1999 | Wierenga et al. | 510/433 |
| 6,096,701 | A | * | 8/2000 | Mondin et al. | 510/382 |
| 6,130,196 | A | * | 10/2000 | Mondin et al. | 510/384 |

* cited by examiner

*Primary Examiner*—Yogendra N. Gupta
*Assistant Examiner*—Brian P. Mruk
(74) *Attorney, Agent, or Firm*—Richard E Nanfeldt

(57) ABSTRACT

An improvement is described in compositions which are especially effective in disinfecting the surface being cleaned and in the removal of oily and greasy soil without leaving streaks which contains a mixture of at least one nonionic surfactant, a cationic surfactant, an anionic surfactant and a hydrocarbon ingredient, a water soluble solvent, and water.

5 Claims, No Drawings

ANTIMICROBIAL MULTI PURPOSE CONTAINING A CATIONIC SURFACTANT

RELATED APPLICATION

This application is a continuation in part application of U.S. Ser. No. 9/342,354 filed Jun. 26, 1999 U.S. Pat. No. 6,130,196.

FIELD OF THE INVENTION

This invention relates to an improved multi purpose liquid cleaner in a form, in particular for cleaning and disinfecting hard surfaces and which is effective in sanitizing surfaces, in removing grease soil in removing lime scale and soap scum and also dries fast leaving the surfaces streak free.

BACKGROUND OF THE INVENTION

Disinfectant composition based on cationic and nonionic are well known. However, these compositions while very efficient in disinfecting surfaces, generally do not remove grease and oil as desired; hence, leaving residues and streaks on surfaces. Addition of an efficient anionic surfactant cleaner, to the cationic surfactant, either creates instability problems or deactivates the disinfectant behavior of the cationic. Anionic and nonionic mixtures have a good grease removal properties, but do not perform at all to sanitize the surface being cleaned.

Acidic composition to remove lime scale also exist. Usually they provide some disinfecting behavior and some of them are highly effective in removing lime scale but they are not performing in grease removal and leave streaks and residues.

SUMMARY OF THE INVENTION

In one aspect, the invention generally provides a stable, clear multi purpose, hard surface cleaning composition having a pH of about 2.5 to 4.5 which is especially effective in disinfecting the surface being cleaned and in the removal of lime scale and greasy oil. These compositions also have a fast drying out time and does not leave streaks on the surface being cleaned. The compositions include approximately, on a weight basis:

0.1% to 8% of an anionic sulfonate surfactant;

0.1% to 10% of a nonionic surfactant formed from the condensation product of a $C_9$–$C_{18}$ alkanol, ethylene oxide and propylene oxide;

from 0 to 8%,more preferably 0.5% to 6% of at least one nonionic surfactant formed from the condensation product of a $C_9$–$C_{18}$ alkanol and ethylene oxide;

from 0.1 to 10% of at least one disinfecting agent;

0 to 10% of at least one water soluble glycol ether solvent;

0.1% to 2.5% of a fatty acid;

0 to 10%, more preferably 0.1% to 6% of an ethoxylated alkyl ester nonionic surfactant;

0 to 8%, more preferably 0.1% to 6% of an ethoxylated alcohol;

0.05% to 3.0%, more preferably 0.1% to 1% of a perfume, water insoluble organic compound or essential oil; and the balance being water.

DETAILED DESCRIPTION OF THE INVENTION

The present invention relates to a stable hard surface cleaning composition comprising approximately by weight:

0.1% to 8% of an anionic surfactant;

0.1% to 10% of a nonionic surfactant formed from the condensation product of a $C_9$–$C_{18}$ alkanol, ethylene oxide and propylene oxide;

0 to 8%, more preferably 0.5% to 6% of at least one nonionic surfactant formed from the condensation product of a $C_9$–$C_{18}$ alkanol and ethylene oxide;

0 to 8%, more preferably 0.1% to 6% of an ethoxylated alcohol;

0.1% to 10% of at least one disinfecting agent such as a cationic surfactant, 0.1% to 2.5% of a fatty acid, 0 to 10%, more preferably 0.1% to 6% of an ethoxylated alkyl ester nonionic surfactant;

0 to 10% of at least one water soluble glycol solvent;

0.05% to 3.0%, more preferably 0.1% to 1% of a water insoluble organic compound, essential oil, or a perfume, and the balance being water, wherein the composition does not contain a pyrrolidone compound or a $C_4$–$C_{12}$ alcohol ester of a sulfosuccinic acid, an amphoteric surfactant, a dialkanol amine, trialkanol amine or an alkali metal hydroxide.

Excluded from the instant composition are ethoxylated glycerol type compounds, alkyl and/or alkenyl oligoglycoside of formula:

$$R^1—O—[G]_p$$

in which $R^1$ represents a linear or branched alkyl or alkenyl group with 8 to 22 carbon atoms, [G] represents a glycose unit with 5 or 6 carbon atoms, preferably a glucose unit, and p represents a number from 1 to 10, and an alkyl ether of formula:

$$R^2O—(CH_2\overset{\overset{\displaystyle CH_3}{|}}{C}HO)_x(CH_2CH_2O)_yH$$

in which $R^2$ represents a linear or branched aliphatic alkyl and/or alkenyl group with 8 to 18, preferably 8 to 14 carbon atoms, x represents 0 or a number of up to 3, preferably up to 2, and y represents a number from 1 to 15, preferably 2 to 12, especially 2.5 to 10.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 10% to 70% by weight, the essential oils themselves being volatile odoriferous compounds and also serving to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc.

The water insoluble organic compound, essential oil or perfume is present in the composition in an amount of from 0.05% to 3% by weight, preferably from 0.1% to 1% by weight.

Furthermore, although superior grease removal performance will be achieved for perfume compositions not containing any terpene solvents, it is apparently difficult for perfumers to formulate sufficiently inexpensive perfume compositions for products of this type (i.e., very cost sensitive consumer-type products) which includes less than 20%, usually less than 30%, of such terpene solvents.

The water insoluble saturated or unsaturated organic compound is selected from the group consisting of water insoluble hydrocarbons containing a cycloalkyl group having 5 to 10 carbon atoms, wherein the alkyl or cycloalkyl group can be saturated or unsaturated and the cycloalkyl group can have one or more saturated or unsaturated alkyl groups having 1 to 20 carbon atoms affixed to the alkyl or cycloalkyl group and one or more halogens, alcohols, nitro or ester group substituted on the cycloalkyl group or alkyl group; aromatic hydrocarbons; water insoluble ethers; water insoluble carboxylic acids, water insoluble alcohols, water insoluble amines, water insoluble esters, nitropropane, 2,5dimethylhydrofuran, 2-ethyl2-methyl 1,3dioxolane, 3-ethyl 4-propyl tetrahydropyran, N-isopropyl morpholine, alpha-methyl benzyldimethylamine, methyl chloraform and methyl perchlorapropane, and mixtures thereof. Typical hydrocarbons are cyclohexyl-1 decane, methyl-3 cyclohexyl-9 nonane, methyl-3 cyclohexyl-6 nononane, dimethyl cycloheplane, trimethyl cyclopentane, ethyl-2 isopropyl-4 cyclohexane. Typical aromatic hydrocarbons are bromotoluene, diethyl benzene, cyclohexyl bromoxylene, ethyl-3 pentyl-4 toluene, tetrahydronaphthalene, nitrobenzene, and methyl naphthalene. Typical water insoluble esters are benzyl acetate, dicyclopentadienylacetate, isononyl acetate, isobornyl acetate and isobutyl isobutyrate. Typical water insoluble ethers are di(alphamethyl benzyl) ether, and diphenyl ether. A typical alcohol is phenoxyethanol. A typical water insoluble nitro derivative is nitro propane.

Suitable essential oils are selected from the group consisting of: Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Cananga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen, Allocimene, Arbanex™, Arbanol®, Bergamot oils, Camphene, Alpha-Campholenic aldehyde, I-Carvone, Cineoles, Citral, Citronellol Terpenes, Alpha-Citronellol, Citronellyl Acetate, Citronellyl Nitrile, Para-Cymene, Dihydroanethole, Dihydrocarveol, d-Dihydrocarvone, Dihydrolinalool, Dihydromyrcene, Dihydromyrcenol, Dihydromyrcenyl Acetate, Dihydroterpineol, Dimethyloctanal, Dimethyloctanol, Dimethyloctanyl Acetate, Estragole, Ethyl-2 Methylbutyrate, Fenchol, Fernlol™, Florilys™, Geraniol, Geranyl Acetate, Geranyl Nitrile, Glidmint™ Mint oils, Glidox™, Grapefruit oils, trans-2-Hexenal, trans-2-Hexenol, cis-3-Hexenyl Isovalerate, cis-3-Hexanyl-2-methylbutyrate, Hexyl Isovalerate, Hexyl-2-methylbutyrate, Hydroxycitronellal, Ionone, Isobornyl Methylether, Linalool, Linalool Oxide, Linalyl Acetate, Menthane Hydroperoxide, I-Methyl Acetate, Methyl Hexyl Ether, Methyl-2-methylbutyrate, 2-Methylbutyl Isovalerate, Myrcene, Nerol, Neryl Acetate, 3-Octanol, 3 -Octyl Acetate, Phenyl Ethyl-2-methylbutyrate, Petitgrain oil, cis-Pinane, Pinane Hydroperoxide, Pinanol, Pine Ester, Pine Needle oils, Pine oil, alpha-Pinene, beta-Pinene, alpha-Pinene Oxide, Plinol, Plinyl Acetate, Pseudo Ionone, Rhodinol, Rhodinyl Acetate, Spice oils, alpha-Terpinene, gamma-Terpinene, Terpinene-4-OL, Terpineol, Terpinolene, Terpinyl Acetate, Tetrahydrolinalool, Tetrahydrolinalyl Acetate, Tetrahydromyrcenol, Tetralol®, Tomato oils, Vitalizair, Zestoral™, HINOKITIOL™ and THUJOPSIS DOLABRATA™.

The anionic sulfonate surfactants which may be used in the detergent of this invention are water soluble and include the sodium, potassium, ammonium and ethanolammonium salts of linear $C_8$–$C_{16}$ alkyl benzene sulfonates; $C_{10}$–$C_{20}$ paraffin sulfonates, alpha olefin sulfonates containing about 10–24 carbon atoms and $C_8$–$C_{18}$ alkyl sulfates and mixtures thereof. The preferred anionic sulfonate surfactant is a $C_{12-18}$ paraffin sulfonate present in the composition at a concentration of about 0.1% to 8wt. %, more preferably 0.25% to 6%.

The paraffin sulfonates may be monosulfonates or di-sulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains. Paraffin sulfonates that have the sulfonate group(s) distributed along the paraffin chain are described in U.S. Pat. Nos. 2,503,280; 2,507,088; 3,260,744; and 3,372,188; and also in German Patent 735,096. Such compounds may be made to specifications and desirably the content of paraffin sulfonates outside the $C_{14-17}$ range will be minor and will be minimized, as will be any contents of di- or poly-sulfonates.

Examples of suitable other sulfonated anionic detergents are the well known higher alkyl mononuclear aromatic sulfonates, such as the higher alkylbenzene sulfonates containing 9 to 18 or preferably 9 to 16 carbon atoms in the higher alkyl group in a straight or branched chain, or $C_{8-15}$ alkyl toluene sulfonates. A preferred alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 carbon atoms.

The nonionic surfactants which are used at a concentration of 0.1 to 10 wt. % are the water-soluble condensation products of a $C_8$–$C_{20}$ alkanol with a heteric mixture of ethylene oxide and propylene oxide wherein the weight ratio of ethylene oxide to propylene oxide is from 2.5:1 to 4:1, preferably 2.8:1 to 3.3:1, with the total of the ethylene oxide and propylene oxide (including the terminal ethanol or propanol group) being from 60–85%, preferably 70–80%, by weight. Such surfactants are commercially available from BASF-Wyandotte and a particularly preferred surfactant is a $C_{10}$–$C_{16}$ alkanol condensate with ethylene oxide and propylene oxide, the weight ratio of ethylene oxide to propylene oxide being 3:1 and the total alkoxy content being about 75% by weight.

The Plurafac nonionic surfactants are condensation products of a primary alkanol having 9 to 18 carbon atoms with 1 to 5 moles of ethylene oxide and 1 to 5 moles of propylene oxide. Preferred is Plurafac LF300 which is formed from the condensation product of hexanol with 5 moles of ethylene oxide and 1 mole of propylene oxide.

The water soluble nonionic surfactants utilized in this invention at a concentration of 0 to 8 wt. %, more preferably 0.5 to 8 wt. % are commercially well known and include the primary aliphatic alcohol ethoxylates, secondary aliphatic alcohol ethoxylates and alkylphenol ethoxylates. The nonionic synthetic organic surfactants generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic detergent class includes the condensation products of a higher alcohol (e.g., an alkanol containing about 9 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohol containing about 9–15 carbon atoms, such as $C_9$–$C_{11}$ alkanol condensed with 2.5 TO 10 moles of ethylene oxide (NEODOL 91-2.5 OR -5 OR -6 OR -8), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like.

An especially preferred nonionic system comprises the mixture of a nonionic surfactant formed from a $C_9$–$C_{11}$ alkanol condensed with 2 to 3.5 moles of ethylene oxide ($C_{9-11}$ alcohol EO 2 to 3.5:1) with a nonionic surfactant formed from a $C_9$–$C_{11}$ alkanol condensed with 7 to 9 moles of ethylene oxide ($C_9$–$C_{11}$ alcohol EO 7 to 9:1), wherein the weight ratio of the $C_9$–$C_{11}$ alcohol EO 7 to 9:1 to the $C_9$–$C_{11}$ alcohol EO 2 to 3.5:1 is from 4:1 to 1:1 from preferably 3.5:1 to 2:1.

Additional satisfactory water soluble alcohol ethylene oxide condensates are the condensation products of a secondary aliphatic alcohol containing 9 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic detergents include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl phenol condensed with about 9.5 moles of EO per mole of nonyl phenol, dinonyl phenol condensed with about 12 moles of EO per mole of phenol, dinonyl phenol condensed with about 15 moles of EO per mole of phenol and di-isoctylphenol condensed with about 15 moles of EO per mole of phenol. Commercially available nonionic surfactants of this type include Igepal CO-630 (nonyl phenol ethoxylate) marketed by GAF Corporation.

The ethoxylated alkyl ester nonionic surfactant has the structure of:

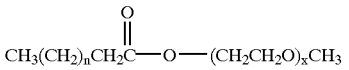

wherein n is a number from 2 to 18, preferably 3 to 15 and x is a number from 6 to 12, preferably 8 to 10. Preferred ethoxylated alkyl esters are Genagen™ 24 and Genagen™ 81.

The major class of compounds found to provide highly suitable water soluble solvent for the composition are water-soluble polyethylene glycols having a molecular weight of 150 to 1000, polypropylene glycol of the formula $HO(CH_3CHCH_2O)_nH$ wherein n is a number from 2 to 18, mixtures of polyethylene glycol and polypropyl glycol (Synalox) and mono and di $C_{1-C6}$ alkyl ethers and esters of ethylene glycol and propylene glycol having the structural formulas $R(X)_nOH$ $R_1(X)_nOH$ $R(X)_nOR$ and $R_1(X)_nOR_1$ wherein R is $C_1$–$C_6$ alkyl group, $R_1$ is $C_2$–$C_4$ acyl group, X is $(OCH_2CH_2)$ or $(OCH_2(CH_3)CH)$ and n is a number from 1 to 4, diethylene glycol, triethylene glycol, an alkyl lactate, wherein the alkyl group has 1 to 6 carbon atoms, 1 methoxy-2-propanol, 1 methoxy-3-propanol, and 1 methoxy 2-, 3- or 4-butanol.

Representative members of the polypropylene glycol include dipropylene glycol and polypropylene glycol having a molecular weight of 150 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether and mono, di, tributylene glycol monohexyl ether, ethylene glycol monoacetate and dipropylene glycol propionate. These glycol type water soluble solvents are at a concentration of about 0 to about 10weight %, more preferably about 0.5weight % to about 8%. Additional water soluble solvent useful in the instant compositions are $C_1$–$C_3$ alcohols such as methanol, ethanol and isopropanol which can be used in blend with above mentioned glycol ethers blends weight ratios of glycol ethers and alcohol are 1:5 to 5:1, more preferably 1:1.

The instant invention can contain 0 to 8 wt. %, more preferably 0.1 wt. % to 6% of an ethoxylated alcohol selected from the group consisting of $C_5$–$C_7$ alkyl ethoxylates having from 1 to 6 EO groups and $C_5$–$C_7$ alkyl ethoxylate-propoxylates having 1 to 6 EO groups and 0.5 to 3 PO groups.

Generally, amounts of water soluble solvents in the range of from 0.1 wt. % to 10wt. %, preferably from about 0.5 wt. % to 8 wt. % provide stable compositions for the above-described levels of primary surfactants and water insoluble hydrocarbon, perfume or essential and any other additional ingredients as described below.

The instant compositions contain about 0.1 to about 10 wt. %, more preferably 0.25 to 8 wt. % of a disinfectant agent selected from the group consisting of $C_8$–$C_{16}$ alkyl amines, $C_8$–$C_{16}$ alkyl benzyl dimethyl ammonium chlorides, $C_8$–$C_{16}$ dialkyl dimethyl ammonium chlories, $C_8$–$C_{16}$ alkyl, $C_8$–$C_{14}$ alkyl dimethyl ammonium chloride and chlorhexidine and mixtures thereof. Some typical disinfectant agent useful in the instant compositions are manufactured by Lonza, S. A. They are: Bardac 2180 (or 2170) which is N-decyl-N-isonoxyl-N, N-dimethyl ammonium chloride; Bardac 22 which is didecyl dimethyl ammonium chloride; Bardac LF which is N,Ndioctyl-N, N-dimethyl ammonium chloride; Bardac 114 which is a mixture in a ratio of 1:1:1 of N-alkyl-N, N-didecyl -N, N-dimethyl ammonium chloride/N-alkyl-N, N-dimethyl-N-ethyl ammonium chloride; and Barquat MB-50 which is N-alkyl-N, N-dimethyl-N-benzyl ammonium chloride.

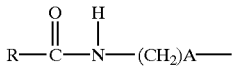

Another disinfecting agent is dimethyl benzyl alkonium chloride (BASF).

An essential ingredient in the inventive compositions having improved interfacial tension properties is water. The proportion of water in the compositions generally is in the range of 10% to 97%, preferably 70% to 97% by weight.

In addition to the above-described essential ingredients, the compositions of this invention may often and preferably do contain one or more additional ingredients which serve to improve overall product performance.

The instant compositions can include from 0 to 2.5%, preferably from 0.1% to 2.0% by weight of the composition of a $C_8$–$C_{22}$ fatty acid or fatty acid soap as a foam suppressant.

The addition of fatty acid or fatty acid soap provides an improvement in the rinseability of the composition whether applied in neat or diluted form. Generally, however, it is necessary to increase the level of cosurfactant to maintain product stability when the fatty acid or soap is present. If more than 2.5 wt. % of a fatty acid is used in the instant compositions, the composition will become unstable at low temperatures as well as having an objectionable smell.

As example of the fatty acids which can be used as such or in the form of soap, mention can be made of distilled coconut oil fatty acids, "mixed vegetable" type fatty acids (e.g. high percent of saturated, mono-and/or polyunsaturated $C_{18}$ chains); oleic acid, stearic acid, palmitic acid, eiocosanoic acid, and the like, generally those fatty acids having from 8 to 22 carbon atoms being acceptable.

The multi purpose liquid cleaning composition of this invention may, if desired, also contain other components either to provide additional effect or to make the product more attractive to the consumer. The following are mentioned by way of example: Colors or dyes in amounts up to 0.5% by weight, 2,6-di-tert.butyl-p-cresol, etc., in amounts up to 2% by weight; and pH adjusting agents, such as sulfuric acid or sodium hydroxide, as needed. Furthermore, if opaque compositions are desired, up to 4% by weight of an opacifier may be added.

In their final form, the multi purpose liquids are clear compositions and exhibit stability at reduced and increased temperatures. More specifically, such compositions remain clear and stable in the range of 5° C. to 50° C., especially 10° C. to 43° C. and the compositions exhibit a pH in the neutral to the alkaline range.

The compositions are directly ready for use as desired and only minimal rinsing is required and substantially no residue or streaks are left behind. Furthermore, because the compositions are free of detergent builders such as alkali metal polyphosphates they are environmentally acceptable and provide a better "shine" on cleaned hard surfaces.

When intended for use in the neat form, the liquid compositions can be packaged under pressure in an aerosol container or in a pump-type sprayer for the so-called spray-and-wipe type of application. The composition can also be dispensed from a non woven or fabric towel which can be used once and discarded or reused several times with adequate rinsing between usage.

Because the compositions as prepared are aqueous liquid formulations, the compositions are easily prepared simply by combining all the ingredients in a suitable vessel or container. The order of mixing the ingredients is not particularly important and generally the various ingredients can be added sequentially or all at once or in the form of aqueous solutions of each or all of the primary detergents and cosurfactants can be separately prepared and combined with each other and with the perfume. It is not necessary to use elevated temperatures in the formation step and room temperature is sufficient.

The instant formulas explicitly exclude alkali metal silicates and alkali metal builders such as alkali metal polyphosphates, alkali metal carbonates, alkali metal phosphonates and alkali metal citrates because if these builders were used in the instant composition, they would cause the composition to have a high pH as well as leaving residue on the surface being cleaned.

The following examples illustrate liquid cleaning compositions of the described invention. The exemplified compositions are illustrative only and do not limit the scope of the invention. Unless otherwise specified, the proportions in the examples and elsewhere in the specification are by weight.

Example 1

The following compositions in wt. % were prepared by simple mixing procedure:

| | A Ref. | B Ref. | C1 | D1 | E1 | F1 | G1 | H1 | 11 | J1 | K1 | L1 | M1 | N1 |
|---|---|---|---|---|---|---|---|---|---|---|---|---|---|---|
| H2O | Bal. | Bal. | Bal. | Bal. | Bal. | Bal. | Bal. | Bal. | Bal. | Bal. | Bal. | Bal. | Bal. | Bal. |
| Paraffin sulfonate | 7.27 | 5.6 | 2 | 2 | 2 | 2 | 2 | 2 | 2 | 2 | 2 | 2 | 2 | 2 |
| Plurafac LF300 | | 0.9 | 4 | 4 | 4 | 4 | 4 | 4 | 4 | 4 | 4 | 4 | 4 | 4 |
| Neodol 91/2.5 | | | 2 | | | 2 | | | 2 | | | | | |
| NCA820 | | | | 2 | | | 2 | | | 2 | | | | |
| MEE | | | | | 2 | | | 2 | | | 2 | | | |
| Levenol F200 | 2.14 | 0.9 | | | | | | | | | | 2 | 2 | 2 |
| DEGMBE | 4 | 4.8 | 4 | 4 | 4 | | | | | | | 4 | | |
| MgSO4&H2O | 1.5 | 0.9 | | | | | | | | | | | | |
| Hexanol 5EO | | | | | | 4 | 4 | 4 | | | | | 4 | |
| Hexanol PO:EO | | | | | | | | | 4 | 4 | 4 | | | 4 |
| Coconut fatty acid | 0.7 | 045 | 0.5 | 0.5 | 0.5 | 0.5 | 0.5 | 0.5 | 0.5 | 0.5 | 0.5 | 0.5 | 0.5 | 0.5 |
| KLC5O (50%) | | | 3.5 | 3.5 | 3.5 | 3.5 | 3.5 | 3.5 | 3.5 | 3.5 | 3.5 | 3.5 | 3.5 | 3.5 |
| Perfume | 0.8 | 0.8 | 0.8 | 0.8 | 0.8 | 0.8 | 0.8 | 0.8 | 0.8 | 0.8 | 0.8 | 0.8 | 0.8 | 0.8 |
| Grease cutting - dilute | | | | | | | | | | | | | | |
| Versus Ref 1* | | | Better | Better | Better | Better | Better | Better | | | | Better | Better | |
| Versus Ref 2* | | | Equal | Better | Better | Better | Better | Better | | | | Better | Better | |
| Foam collapse | | | | | | | | | | | | | | |
| Versus Ref 1* | | | Equal | Equal | Equal | Equal | Equal | Equal | | | | Equal | Equal | |
| Versus Ref 2* | | | Equal | Equal | Equal | Equal | Equal | Equal | | | | Equal | Equal | |

| | A Ref. | B Ref. | C2 | D2 | E2 | F2 | G2 | H2 | I2 | J2 | K2 | L2 | M2 | N2 |
|---|---|---|---|---|---|---|---|---|---|---|---|---|---|---|
| H2O | Bal. | Bal. | Bal. | Bal. | Bal. | Bal. | Bal. | Bal. | Bal. | Bal. | Bal. | Bal. | Bal. | Bal. |
| Paraffin sulfonate | 7.27 | 5.6 | 1 | 1 | 1 | 1 | 1 | 1 | 1 | 1 | 1 | 1 | 1 | 1 |
| Plurafac LF300 | | 0.9 | 4 | 4 | 4 | 4 | 4 | 4 | 4 | 4 | 4 | 4 | 4 | 4 |
| Neodol 91/2.5 | | | 2 | | | 2 | 2 | 2 | 2 | | | | | |
| NCA820 | | | | 2 | | | | | | 2 | | | | |
| MEE | | | | | 2 | | | | | | 2 | | | |
| Levenol F200 | 2.14 | 0.9 | | | | | | | | | | 2 | 2 | 2 |
| DEGMBE | 4 | 4.8 | 4 | 4 | 4 | | | | | | | 4 | | |
| MgSO4&H2O | 1.5 | 0.9 | | | | | | | | | | | | |
| Hexanol 5EO | | | | | | 4 | 4 | 4 | | | | | 4 | |
| Hexanol PO:EO | | 4 | 4 | 4 | | | 4 | | | | | | | |
| Coconut fatty acid | 0.7 | 0.45 | 0.5 | 0.5 | 0.5 | 0.5 | 0.5 | 0.5 | 0.5 | 0.5 | 0.5 | 0.5 | 0.5 | 0.5 |
| Bardac 2170 | | | 2.5 | 2.5 | 2.5 | 2.5 | 2.5 | 2.5 | 2.5 | 2.5 | 2.5 | 2.5 | 2.5 | 2.5 |
| Perfume | 0.8 | 0.8 | 0.8 | 0.8 | 0.8 | 0.8 | 0.8 | 0.8 | 0.8 | 0.8 | 0.8 | 0.8 | 0.8 | 0.8 |
| Grease cutting - dilute | | | | | | | | | | | | | | |
| Versus Ref 1* | | | Equal | Better | Better | Better | Better | Better | | | | Better | Better | |
| Versus Ref 2* | | | Sl. Worse | Better | Better | Better | Befter | Better | | | | Better | Better | |
| Foam collapse | | | | | | | | | | | | | | |
| Versus Ref 1* | | | Equal | Equal | Equal | Equal | Equal | Equal | | | | Equal | Equal | |
| Versus Ref 2* | | | Equal | Equal | Equal | Equal | Equal | Equal | | | | Equal | Equal | |

Ingredients glossary

Plurafac LF300— nonionic: C13 alcohol EO/PO ex BASF

Neodol 91/2.5— nonionic: $C_9$–$C_{11}$ 2.5 EO ex Shell

MEE— nonionic: methyl ester ethoxylated (Genagen 81 ex Clariant)

Levenol F—200—nonionic: esterified ethoxylated glycerol (KAO)

DEGMBE— cosurfactant: diethylene glycol monobutyl ether (Dow Chemical)

Bardac 2170— dialkyldimethyl ammonium chloride (Lonza)

KLC50— diemthyl benzylalkonium chloride (BASF)

NCA820— nonionic alcohol alkoxylated low form ex. ICI

What is claimed:

1. A cleaning composition comprising approximately by weight:

(a) 0.1% to 10% of at least one disinfecting agent;

(b) 0.1 wt. % to 10 wt. % of at least one surfactant which is a nonionic surfactant formed from the condensation product of a $C_9$–$C_{18}$ alkanol and ethylene oxide and propylene oxides;

(c) 0.1% to 8% of an anionic sulfonate surfactant;

(d) 0.1% to 6% of an ethoxylated alcohol selected from the group consisting of $C_5$–$C_7$ alkyl ethoxylates and $C_5$–$C_7$ alkyl ethoxylate/propoxylates;

(e) 0.1% to 2.5% of a fatty acid;

(f) 0.05% to 3% of a water insoluble organic hydrocarbon, essential oil or a perfume; and (g) the balance being water.

2. The composition according to claim 1, wherein the disinfecting agent is selected from the group consisting of $C_8$–$C_{16}$ alkyl amines, $C_8$–$C_{16}$ alkyl benzyl dimethyl ammonium chlorides, $C_8$–$C_{16}$ dialkyl dimethyl ammonium chlorides, $C_8$–$C_{14}$ alkyl dimethyl ammonium chloride, dimethyl benzyl alkonium chloride, chlorhexidine and mixtures thereof.

3. The composition according to claim 1, further including a $C_1$–$C_3$ alcohol.

4. The composition of claim 1 further including a surfactant formed from the condensates product of a $C_9$–$C_{18}$ alkanol and ethylene oxide.

5. The composition of claim 1 further including an ethoxylated alkyl ester nonionic surfactant.

* * * * *